US007722022B2

(12) United States Patent
Scarpellini et al.

(10) Patent No.: US 7,722,022 B2
(45) Date of Patent: May 25, 2010

(54) MACHINE FOR TRIMMING THE FORE-EDGE OF BOOKS PROVIDED WITH A FLAPPED COVER

(75) Inventors: Massimo Scarpellini, Brusaporto (IT); Dario Scarpellini, Brusaporto (IT); Claudio Crovetto, Seriate (IT)

(73) Assignee: SCS Automaberg S.N.C, Dalmine (BG) (IT)

( * ) Notice: Subject to any disclaimer, the term of this patent is extended or adjusted under 35 U.S.C. 154(b) by 584 days.

(21) Appl. No.: 11/713,950

(22) Filed: Feb. 27, 2007

(65) Prior Publication Data

US 2007/0210504 A1 Sep. 13, 2007

(30) Foreign Application Priority Data

Mar. 10, 2006 (EP) ..... 06110940

(51) Int. Cl.
*B42C 1/00* (2006.01)

(52) U.S. Cl. ..... 270/58.07; 270/21.1; 270/52.17; 412/16; 412/18; 412/25; 83/934

(58) Field of Classification Search ..... 270/21.1, 270/52.17, 58.07; 412/16, 18, 25; 83/934
See application file for complete search history.

(56) References Cited

FOREIGN PATENT DOCUMENTS

| | | | |
|---|---|---|---|
| DE | 103 28 337 | B3 | 2/2005 |
| DE | 19946974 | B4 | 12/2005 |
| EP | 0 754 566 | A | 1/1997 |
| EP | 1 053 890 | A | 11/2000 |
| IT | MI2002A001035 | | 11/2003 |
| JP | 2002 127637 | A | 5/2002 |

OTHER PUBLICATIONS

Prior art submitted by Opponent 1 (Kolbus GmbH & Co.) against EP 1832437: Declaration by Wolfgang Bokamper dated Nov. 4, 2008 with the following attachments: 1) Offer/Invoice to Meinders & Elstermann from Kolbus, Feb. 2005. 2) CERMI Front Cutting Unit 1345 Operating Manual, Oct. 2004. 3) DVD of CERMI XCR 100, 4) 6 Pictures of CERMI XCR 100 (on CD).

(Continued)

*Primary Examiner*—Gene Crawford
*Assistant Examiner*—Leslie A Nicholson, III
(74) *Attorney, Agent, or Firm*—Ladas & Parry, LLP

(57) ABSTRACT

A machine is provided for trimming the fore-edge of books including at least one conveyor device having two superposed belts mounted about relative pulleys, the distance between the adjacent branches of the two belts being equal to the thickness of the books, which are fed to one end of the conveyor device with their spine parallel to its direction of movement and their fore-edge to be trimmed projecting from the belts, a trimming blade movable in a vertical plane parallel to the direction of movement of the books, and a presser and counter-presser to make contact with opposing parts of a book block which are adjacent to the cutting plane of the trimming blade. The machine further comprises two furrowers, one for each of the two faces of the books to open openable book parts before the trimming operation.

9 Claims, 6 Drawing Sheets

OTHER PUBLICATIONS

Prior art submitted by Opponent 2 (MBT) against EP 1832437: 1) drawings E6-E9 (on CD), 2) photos E14-E15 (on CD), 3) transport document E16 dated Oct. 7, 2005 in the name of the company Domus and document E17 dated Jan. 19, 2006 in the name of Books & Magazines, and 4) DVD showing the alleged Zinko machine and an animation of this machine.

Response by Applicant to the Opposition against EP 1832437, Oct. 1, 2009.

MACHINE FOR TRIMMING THE FORE-EDGE OF BOOKS PROVIDED WITH A FLAPPED COVER

The present invention relates to a machine for trimming the fore-edge of books with a cover the two openable parts of which are provided at the book fore-edge with respective inwardly folded flaps.

In the case of books in which the various component signatures forming the so-called book block are sewn at the spine, if provided with a flexible cover the three edges of the book other than the spine are traditionally trimmed by a so-called three knife trimmer, this operation being effected after the book block has been applied to the flexible cover by a machine known as a perfect binder. This latter is positioned in the production line upstream of the three knife trimmer.

Recently there has been an increasing request for books with their spine sewn or milled and their cover provided at the fore-edge with respective flaps folded inwards from the cover. The additional surface obtained by providing these two flaps is used in various ways, for example to briefly carry the biographical data of the book author or a short summary of the book contents, or is used by the publisher to publicize other books.

However, books with a double flapped cover present production problems. In contrast to books with a flapless cover, it is not possible to simultaneously trim the three book edges other than the spine without removing the two flaps. To overcome this problem the following solution has been used: two of the three trimming blades are firstly removed from the three knife trimmer of a normal production line, leaving only the blade for trimming the spine, the thus modified three knife trimmer then being used to trim the fore-edge of the book blocks before applying the cover to them (with the drawback that the production line of which this three knife trimmer formed part could not be used for normal production of books without flaps); said blade is then removed from the three knife trimmer and the other two blades remounted, the production line (in which the three knife trimmer now has two blades) then being fed with the book blocks with the fore-edge already trimmed, the perfect binder of that line then applying the double flapped cover to them, with the three knife trimmer, now with two blades, then trimming the two remaining edges of the book.

This solution requires two passages through the three knife trimmer, one for trimming the fore-edge of the book blocks before applying the flapped cover to them, and the second for trimming the other two parallel edges after applying the cover to them, with the drawback of incurred times and costs decidedly higher than those of normal production (flapless books).

Another solution which has been used consists of adding to a normal production line an additional three knife trimmer in which only the blade for trimming the fore-edge of the book blocks is left (this additional three knife trimmer not being used for normal production), the fore-edge trimming blade being removed from the line three knife trimmer when books with a flapped cover are to be produced. This solution also involves a considerable additional cost as two three knife trimmers (without in this case three knives) have to be provided in the same line, of which the upstream trimmer operates only when flapped covers are to be produced.

It was then suggested to replace said three knife trimmer carrying a single blade by a machine constructed specifically with a single blade for trimming the fore-edge. This machine, precisely because it was designed to carry only one blade, is considerably less costly than a three knife trimmer. Such a machine, to be positioned upstream of the perfect binder, is described in Italian patent application MI2002A001035 of the same proprietor as the present application. However this specific machine was designed to trim the fore-edge of book blocks with a sewn spine, in which the signatures are kept well joined together by the sewing thread, whereas it cannot be used for book blocks with a milled and glued spine (which are rather flimsy, not yet having been provided with a cover).

More recently, trimming machines with a single blade have been constructed, to be located, in contrast to previous machines, downstream of the perfect binder but in a by-pass of the normal production line. If books with a flapped cover are to be produced, these machines enable the spine of books with a flapped cover to be trimmed after sucker means open the two operable parts of the cover, with the relative flap, so that the spine trimming blade does not interfere with the flaps. As these machines receive book blocks already provided with their cover (which gives consistency to the assembly of signatures, i.e. to the book block), these machines can be used both in the case of a sewn spine and in the case of a milled and glued spine.

However these machines also present a problem, due to the fact that said suckers can leave marks on the cover, the more so the more flexible the cover. However they cannot be used if the folded flap has the same length as the corresponding openable part of the cover.

In trimming machines of this type, the trimming blade can be positioned horizontally or vertically. In this latter case the blade can be moved horizontally to adjust its position on the basis of the width of the book to be trimmed. The books move horizontally within the trimming machine on conveyor devices comprising two superposed belts the adjacent branches of which are parallel, the books arriving in succession between these branches with their fore-edge projecting from the belts. The elevation of the upper belt can be adjusted, while that of the lower belt is fixed. The books remain horizontal during trimming, the blade moving from the top downwards, to then rise again into its starting position. Prior to trimming, when the two opposing openable parts of the cover have already been opened by the relative suckers, a presser is rested on the top of the book block close to the fore-edge, the corresponding bottom of the book block of signatures resting simultaneously on a fixed counter-presser on which, following trimming, scrap remains which has to be removed. For this purpose the machine comprises blower means.

Another drawback of these sucker trimmers with a vertical blade is that the presence of the suckers leaves little space for the presser and counter-presser, because of which both the presser and counter-presser have a short length, which negatively affects the quality of the trimming effected by the blade.

In sucker trimmers with a horizontal blade, the books are disposed vertically when in their trimming position, because of which there is no problem of scrap to be removed, this falling by gravity. However the horizontal blade represents a considerable mass to be moved, this requiring an adequate drive mechanism.

An object of the present invention is to provide a machine for trimming the fore-edge of books to which the flapped cover has already been applied, without leaving marks on the cover in any case.

Recently there has been a demand for books with a sewn or milled and glued spine provided with a cover having only one inwardly folded flap.

Another object of the invention is therefore to provide a machine of the aforesaid type which also enables trimming of the fore-edge of books with a single-flap cover.

The first said object is attained by the trimming machine of the present invention, of the type with a vertical fore-edge trimming blade, characterised by comprising two furrower means, one for each of the two faces of the book, each to be inserted, starting from the fore-edge, between the relative openable part of the cover and the book block to open this openable part before the trimming operation is carried out on the fore-edge, to prevent the blade from interfering with the cover.

Preferably, in correspondence with each furrower means there is provided a relative linear support element contained in a vertical plane parallel to the plane of the trimming blade, on the two support elements there directly resting the relative face of that part of the book block projecting from the cover before this latter comes into contact with the relative furrower means, to facilitate opening of the two openable parts of the cover by the relative furrower means.

Conveniently the trimming blade is movable within a fixed vertical plane, counteracting means being provided which act on the book fore-edge to be trimmed, said counteracting means being movable horizontally, perpendicularly to the blade, to move the book or books into a position, relative to the blade, which enables the required fore-edge portion to be removed following trimming.

The use of the furrower means enables the respective openable part of the cover to be opened sufficiently to enable a presser and a counter-presser to be used having a width enabling the book block to be held rigidly during trimming, resulting in perfect trimming.

If the furrower means are made removable, removing one of the two makes it possible to obtain books with a cover provided with only one flap, to hence also attain the second stated object.

Preferably each conveyor device for the books the fore-edge of which is to be trimmed comprises a pair of superposed parallel belts (between which, as already stated, the books are placed with their spine parallel to but distant from the trimming blade) the relative upper belt having fixed elevation while the lower belt is movable vertically in the two directions to be able to adjust the distance between the two adjacent branches of the two belts on the basis of the thickness of the books the fore-edge of which is to be trimmed. As the elevation of the surface on which the books slide within the machine varies depending on the book thickness, an inclinable entry conveyor belt and an inclinable exit conveyor belt have to be provided to join said slide surface to the rest of the line.

Still preferably the counter-presser moves together with the lower belt, so that by adjusting the position of this latter the position of the counter-presser is also automatically adjusted.

The invention will be more apparent from the ensuing description of an embodiment thereof given by way of example. In this description reference will be made to the accompanying drawings, in which.

Figure 6:
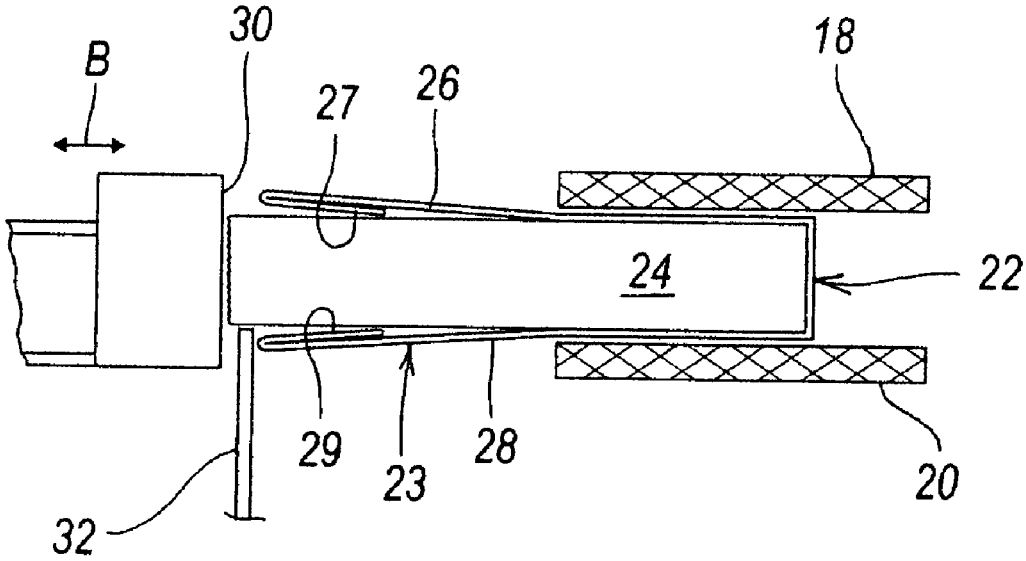
FIG. 6 is a vertical cross-section through the pair of belts, showing schematically a book with flapped cover in its position just prior to encountering the furrower means.

As can be seen from the figures, the machine 10 for trimming the fore-edge of books already provided with a flapped cover comprises a structure indicated overall by 12. In the specific illustrated example, the structure 12 carries a first conveyor belt 14 connecting to the rest of the line and along which the books already provided with the flapped cover enter the machine 10 for trimming of their fore-edge. These books originate from a perfect binder positioned in the production line upstream of the machine 10. They either may or may not have been trimmed along the two parallel edges perpendicular to the spine. In either case the fed books are presented as shown in FIG. 6, in which a book 22 comprises a book block 24 and a cover 23 provided with flaps 27 and 29. As can be seen, the book block 24 projects (by at least 3 mm) from that edge of the cover 23 provided with flaps, so requiring trimming of the fore-edge. The books to be trimmed (not shown for simplicity in FIG. 1) are fed in regular succession to the right end of the conveyor belt 14 such that while they advance in the direction of the arrow A, their spine rests against a reference wall 16 with which the conveyor belt 14 is provided. The position of the reference wall 16 is adjustable in a direction perpendicular to itself by conventional mechanisms on depends on the width of the books the fore-edge of which is to be trimmed.

When a book arrives at the left end of the conveyor belt 14, it is conveyed to a subsequent conveyor device 19 (best seen in FIGS. 4 and 5) comprising two superposed belts 18 and 20, mounted about relative pulleys, the adjacent branches of the two belts being parallel to each other at a distance apart enabling the books originating from the conveyor belt 14 to be received and conveyed between them. The distance between the two belts 18 and 20 is adjustable by conventional mechanisms which enable the lower belt 20 to be raised or lowered on the basis of the height of the books 22 to be trimmed, the fore-edge of these latter projecting from the belts 18, 20 (towards the left, with reference to FIG. 6).

Figure 1:
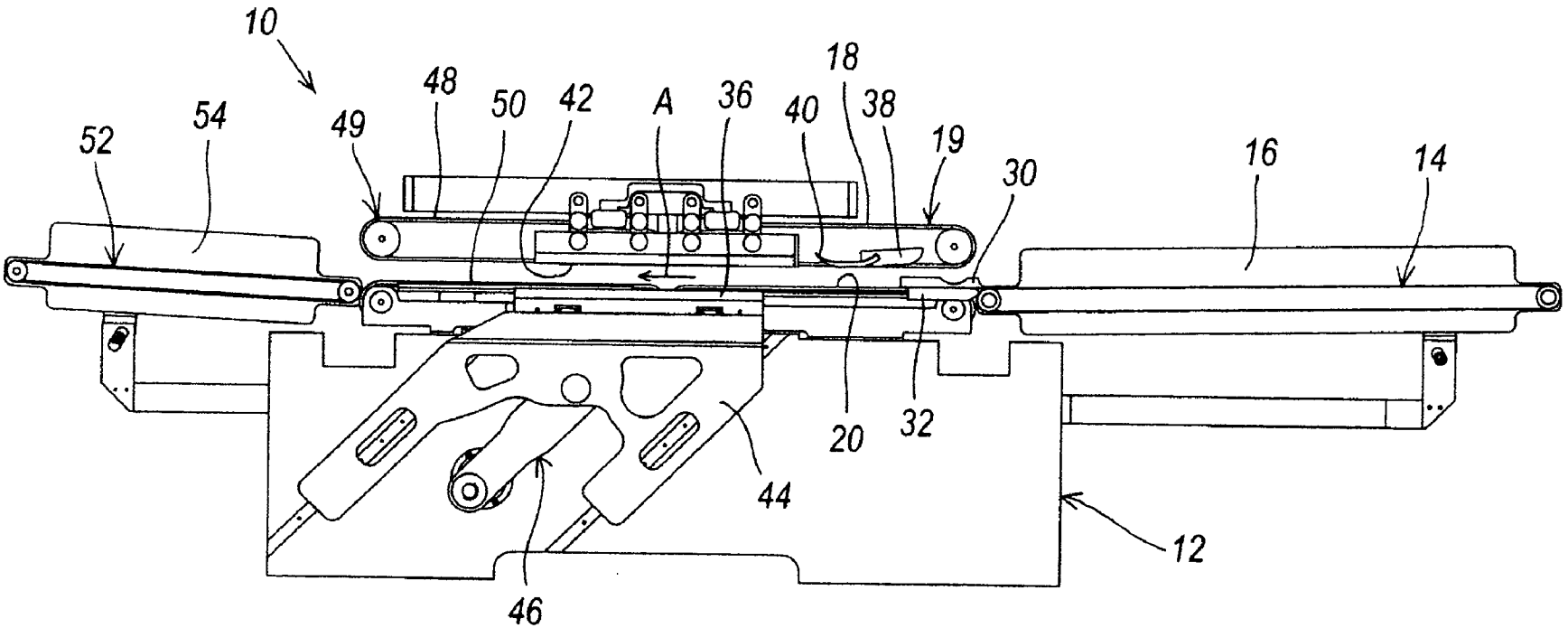
FIG. 1 is a side elevation of a trimming machine according to the present invention.
Figure 5:
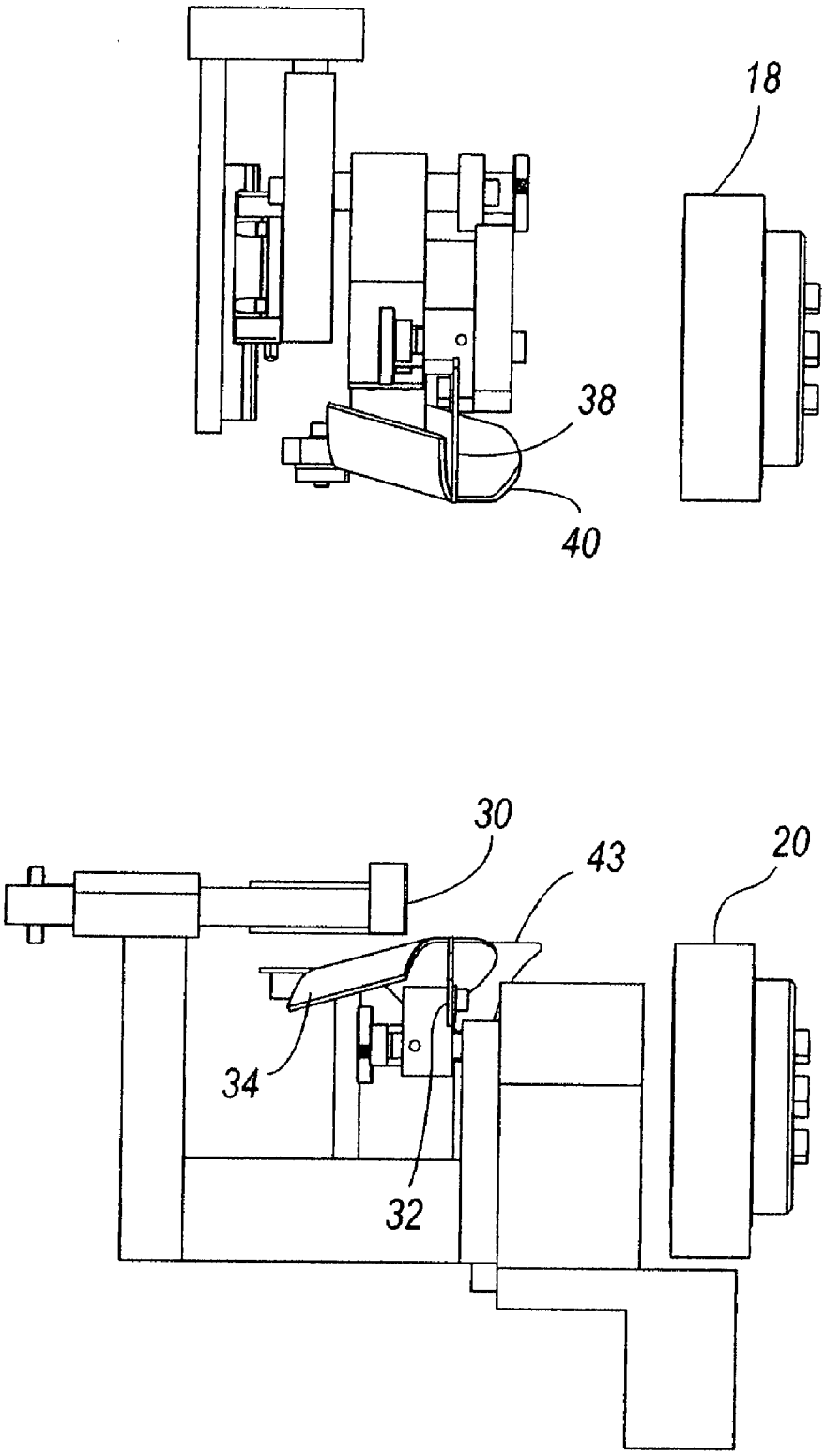
FIG. 5 is a vertical section through the machine taken on the line 5-5 of FIG. 1.

As can be seen from FIGS. 1 and 5, the machine 10 is provided with a scrap adjustment means comprising a pusher 30 (FIGS. 1 and 6) movable horizontally in the two directions (as indicated by the double arrow F of FIG. 6) perpendicular to the direction of advancement of the books 22, by conventional mechanisms. In this manner the amount of the book block 24 to be removed from the fore-edge can be adjusted, so that the trimmed fore-edge does not project from the relative edge of the flapped cover.

Figure 7:
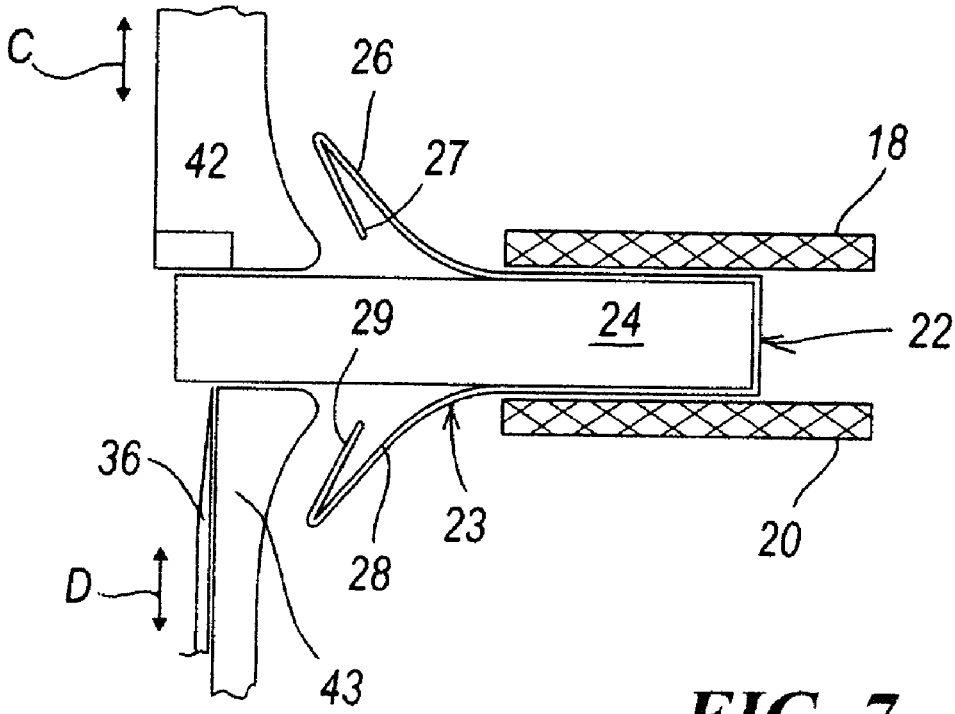
FIG. 7 is similar to FIG. 6, but with the difference that the book is shown in its position just prior to the trimming operation on its fore-edge.

The machine 10 also presents a lower linear support element 32, the upper edge of which is horizontal but is provided towards upstream with a lead-in bevel. The lower face of the book block 24 rests against the lower support element 32, as shown in FIG. 6. Immediately downstream of the lower support 32 there is positioned the furrower means. This is an element, indicated by 34, shaped as a furrower and hereinafter known as the lower furrower. The purpose of this latter is to insert itself between the lower surface of the book block 24 and the folded flap 29 of the lower part 28 of the cover 23 such as to open this lower part 28 outwards (as shown in FIG. 7, in which however the furrower is not shown for simplicity) so that the in the subsequent trimming operation the blade (described hereinafter) does not interfere with the part 28. As will be apparent, the lower linear support element 32 facilitates insertion of the lower furrower 34 between the lower face of the book block 24 and the relative openable part 28 of the cover 23.

Figure 4:
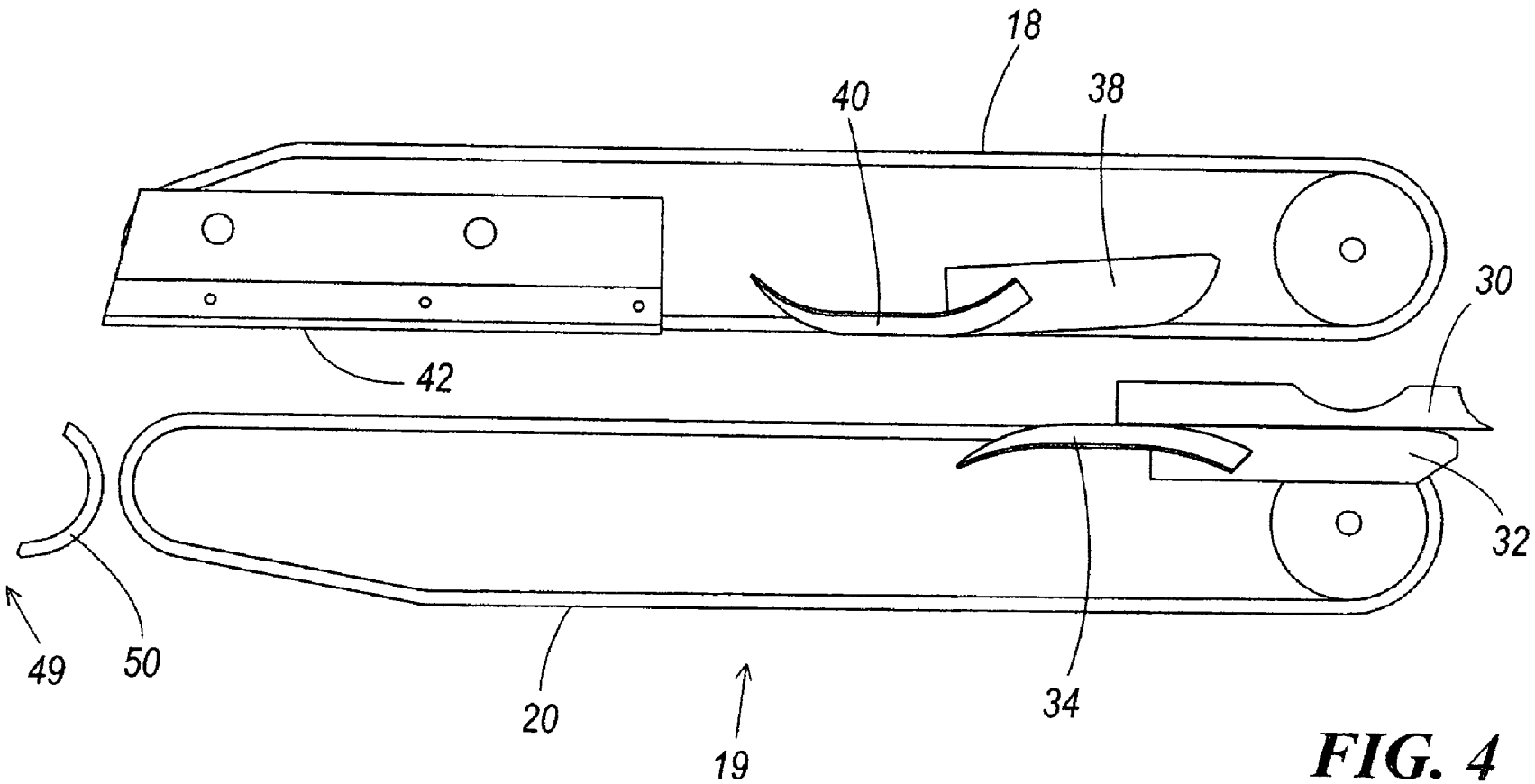
FIG. 4 shows a further enlarged part of FIG. 1 in greater detail, relating to the region comprising the furrower means.

As best seen from FIG. 4, just downstream of the lower linear support element 32 and of the lower furrower 34 there are provided respectively an upper linear support element 38 and, just downstream, an upper furrower 40 the purpose of which is to open the upper openable part 26 of the cover 23 outwards (FIG. 7, in which the upper furrower is also not shown for simplicity).

After an individual book 22, conveyed by the pair of belts 18, 20, encounters the furrowers 34 and 40 during its advancement, it arrives below a presser 42 (FIG. 4) where it halts following the stoppage of the belts 18, 20. The presser 42 is movable vertically in the two directions (as indicated in FIG. 7 by the double arrow C) to assume the position of FIG. 7, i.e. to press against the upper face of the book block 24. As can be seen from this figure, a counter-presser 43 is also present positioned to the side of the trimming blade 36 and of which the elevation is the same as the upper face of the upper branch of the lower belt 20. It will easily be apparent that as the book block 24 is firmly held between the presser 42 and the counter-presser 43, both of adequate width (and decidedly greater than that of the presser and counter-presser present in known sucker trimmers), the subsequent operation of the blade 36—which here moves from the bottom upwards, to make the cut, and then returns to the starting position of FIG. 7 (as indicated by the double arrow D)—enables perfect trimming of the fore-edge of the book 22 to be obtained.

In this case the counter-presser 43 moves vertically rigid with the lower belt 20, so that when the elevation of this latter is adjusted, the elevation of the counter-presser 43 is automatically adjusted.

Figure 2:
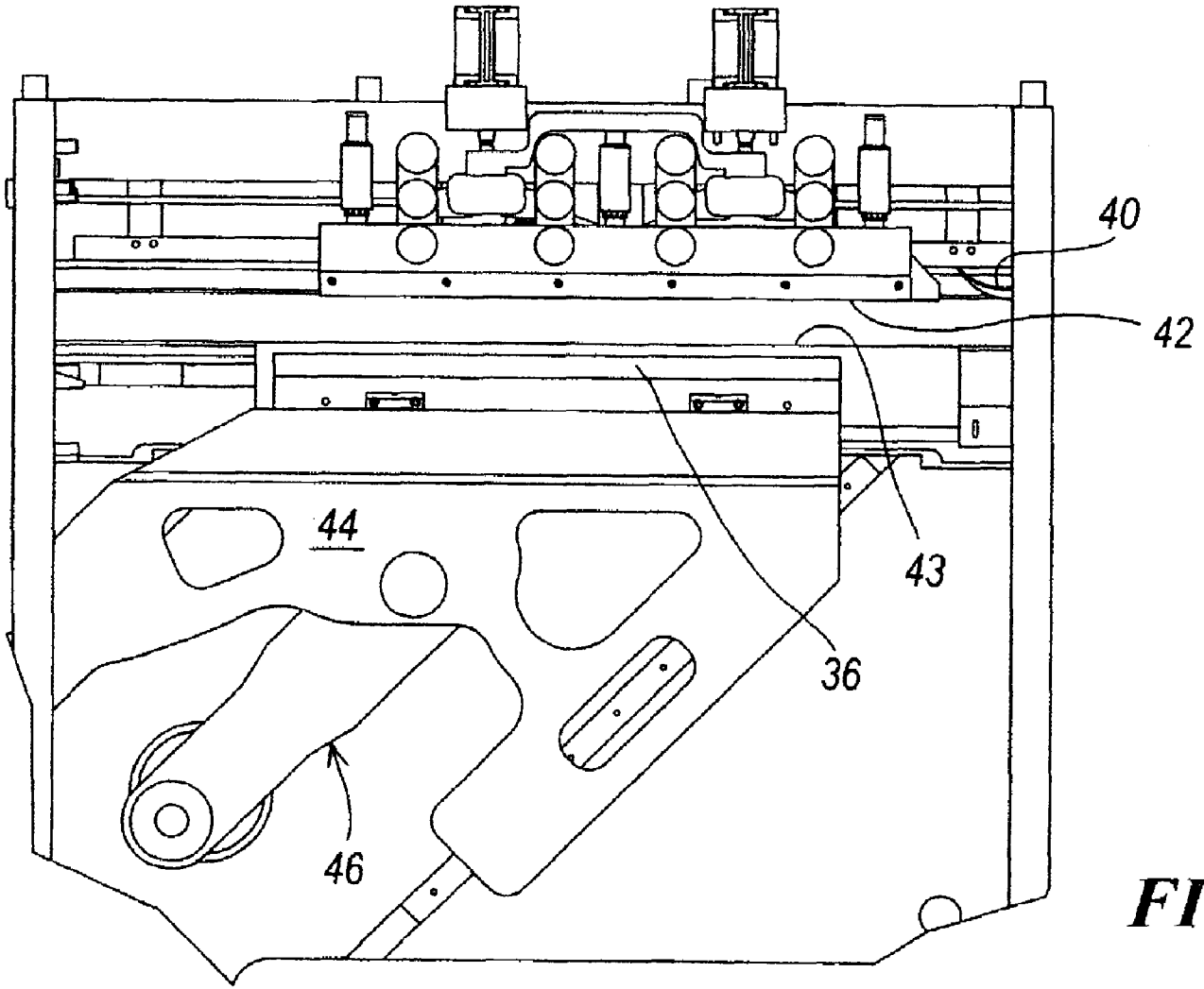
FIG. 2 is an enlarged and more detailed view of part of FIG. 1 relating to the trimming blade region.
Figure 3:
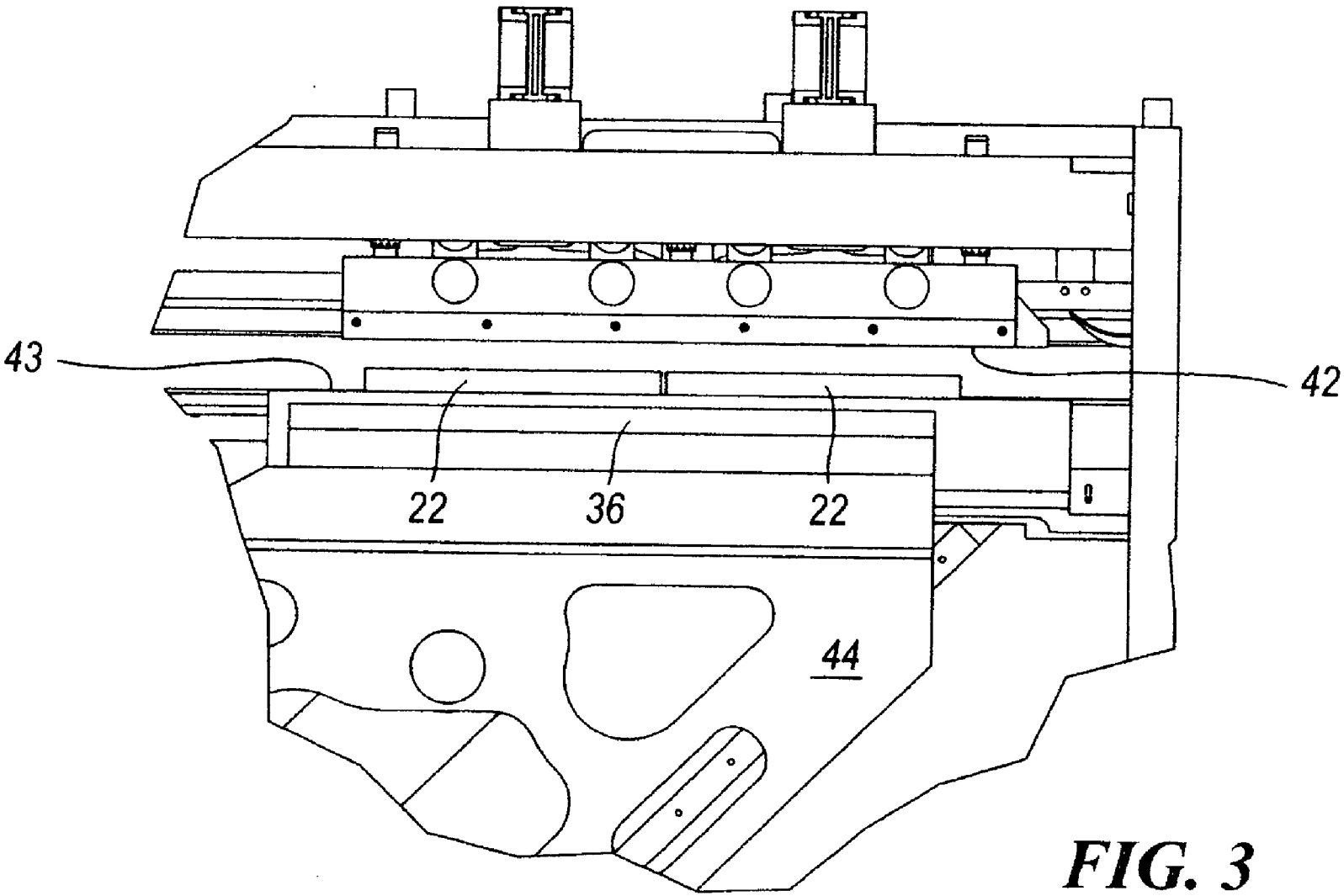
FIG. 3 is an enlarged detail of FIG. 2, showing two books in the position for trimming their fore-edge.

As best seen from FIGS. 2 and 3, the trimming blade 36 is carried by a blade holder 44 which, by means of a connecting rod-crank mechanism (indicated overall by 46), is able to cause the blade 36 to undergo not only a vertical movement in the two directions but also a horizontal translation in the plane in which it lies, so that in practice the blade 36 moves within the vertical plane in a direction inclined at 45° to the horizontal, this facilitating the trimming operation.

As can be seen from FIGS. 1 and 4, the illustrated machine 10 also comprises in reality a second conveyor device 49 of belt type, which comprises belts 48 and 50 and is positioned just downstream of that comprising the belts 18, 20. From the same figures it can also be seen that the presser 42 and counter-presser 43 have a horizontal length involving both the pairs of belts 18, 20 and 48, 50. By suitably controlling the movement of the two conveyor devices 19 and 49, each stroke of the blade 36 can be made to simultaneously trim two books 22, as shown in FIG. 3.

When the trimming operation has been carried out, the presser 42 returns to its raised starting position (FIG. 2) so that, on operating the two pairs of belts 18, 20 and 48, 50, the two simultaneously trimmed books 22 can be fed to the subsequent processes in the line of which the trimming machine 10 forms part. In particular, the machine 10 also comprises an exit conveyor belt 52 with relative reference wall 54, for connection to the remaining part of the line. As the elevation of the resting surface for the books 22 during the trimming operation depends on the book thickness, the exit conveyor belt 52, also carried by the structure 12, is inclinable (as is the feed conveyor 14) for its connection to the downstream part of the production line.

It has already been stated that in the production line of which it forms part, the machine 10 is positioned downstream of the perfect binder and receives books 22 already provided with their cover 23, so that it is able to trim the fore-edge both of books with a sewn spine and of books with a milled and glued spine.

It is important to note that the machine 10 is structured to be able to occupy downstream of the perfect binder that position which in a normal production line is occupied by a portion of the connecting conveyor belt, so that it is not necessary to change the line layout. If the fore-edge of books with a flapless cover is to be trimmed, the reference walls 16 and 54 of the feed conveyor belt 14 and exit conveyor belt 52 have merely to be adjusted so that the books 22 do not interfere with the furrowers 34 and 40, so that the machine 10 (the cutting function of which has been deactivated) acts as a simple connection conveyor device.

It should also be noted that as the elevation of the lower belts 20 and 50 is regulated, the stroke of the blade 36 during the trimming operation is fixed whatever the thickness of the books 22 to be trimmed, this representing a considerable advantage.

The invention claimed is:

1. A machine (10) for trimming the fore-edge of books (22) formed from a book block (24) with its spine either sewn or milled and glued, and from a flexible cover (23) the openable parts (26, 28) of which are provided with respective inwardly folded flaps (27,29), comprising:

at least one conveyor device (19, 49) for conveying the books (22), each conveyor device (19, 49) comprising two superposed belts (18, 20; 48, 50) mounted about relative pulleys, the distance between the adjacent branches of the two belts (18, 20; 48, 50) being equal to the thickness of the books (22), these latter (22) being fed in regular succession to one end of the conveyor device (19, 49) with their spine parallel to its direction of movement (A) and with their fore-edge to be trimmed projecting from the belts (18, 20; 48, 50);

a trimming blade (36) movable in a vertical plane parallel to the direction of movement (A) of the books (22); and a presser (42) and counter-presser (43) to make contact with respectively opposing parts of the book block (24) which are adjacent to the cutting plane of the trimming blade (36);

characterized by comprising two furrowers (34, 40), one for each of the two faces of the books (22), each (34, 40) to be inserted, starting from the fore-edge, between the relative openable part (26, 28) of the cover (23) and the book block (24) to open this openable part (26, 28) before the trimming operation is carried out on the fore-edge, to prevent the blade (36) from interfering with the cover (23).

2. A machine (10) as claimed in claim 1, wherein in correspondence with each furrower (34, 40) there is provided a relative linear support element (32, 38) contained in a vertical plane parallel to the plane of the trimming blade (36), on the two support elements there directly resting the relative face of that part of the book block (24) which projects from the cover (23) before this latter (23) comes into contact with the relative furrower (34, 40), to facilitate opening of the two openable parts (26, 28) of the cover (23) by the relative furrower (34, 40).

3. A machine (10) as claimed in claim 1, wherein the trimming blade (36) is movable within a fixed vertical plane, thruster (30) being provided which acts on the fore-edge and is movable horizontally, perpendicularly to the blade (36), to move the book or books (22) into a position, relative to the blade (36), which enables the required fore-edge portion (24) to be removed following trimming.

4. A machine (10) as claimed in claim 1, wherein each of the two furrowers (34, 40) is removable.

5. A machine (10) as claimed in claim 1, wherein the trimming blade (36) has its cutting edge horizontal and facing upwards, driver (46) being provided for the blade (36) to cause it to move from the bottom upwards to effect trimming.

6. A machine (10) as claimed in claim 5, wherein the blade moves inclined at 45°to the horizontal.

7. A machine (10) as claimed in claim 1, wherein the upper belt (18, 48) of the conveyor device or devices (19, 49) is of fixed elevation while the relative lower belt (20, 50) is movable vertically in the two directions in order to be able to adjust the distance between the two adjacent branches of the two belts (18, 20; 48, 50) on the basis of the thickness of the books (22), the machine (10) also being provided with an inclinable entry conveyor belt (14) and an inclinable exit conveyor belt (52) for joining the rest of the line to the slide surface for the books (22), which consists of the upper surface of the upper branch of the lower belt (20) or of the lower belts (20, 50).

8. A machine (10) as claimed in claim 7, wherein the counter-presser (43) moves vertically in the two directions rigid with the lower belt (20, 50) of the conveyor device (19, 49).

9. A machine (10) as claimed in claim 1, wherein two conveyor devices (19, 49) are provided positioned one behind the other and independently operable, to be able to trim two books (22) at a time.

* * * * *